United States Patent [19]

Hilbertz

[11] Patent Number: 4,461,684

[45] Date of Patent: Jul. 24, 1984

[54] ACCRETION COATING AND MINERALIZATION OF MATERIALS FOR PROTECTION AGAINST BIODEGRADATION

[75] Inventor: Wolf H. Hilbertz, Austin, Tex.

[73] Assignee: The Marine Resources Company, Austin, Tex.

[21] Appl. No.: 234,325

[22] Filed: Feb. 13, 1981

[51] Int. Cl.[3] ..... C25B 1/00

[52] U.S. Cl. ..... 204/132

[58] Field of Search ..... 204/16, 21, 132

[56] References Cited

U.S. PATENT DOCUMENTS

| | | | |
|---|---|---|---|
| 676,704 | 6/1901 | Shuffleton | 204/132 |
| 900,929 | 10/1908 | Howe | 204/132 |
| 948,355 | 2/1910 | Tatro | 204/132 |
| 1,198,867 | 9/1916 | Nodon | 204/132 |
| 1,489,798 | 4/1924 | Tatro | 204/132 |
| 1,582,903 | 5/1926 | Clapp | 204/132 |
| 2,042,030 | 5/1936 | Tainton | 204/21 |
| 4,246,075 | 1/1981 | Hilbertz | 204/23 |

*Primary Examiner*—T. M. Tufariello

*Attorney, Agent, or Firm*—Arnold, White & Durkee

[57] ABSTRACT

By establishing a direct electrical current between electrodes in an electrolyte like seawater, brine or brackish water, calcium carbonates, magnesium hydroxides, and hydrogen are precipitated at the cathode, while at the anode, oxygen and chlorine are produced. The electrochemical precipitation of minerals at the surface, to form a coating, or internally, to mineralize, of organic fibrous material, such as wood, is utilized to prevent attack by fouling and boring organisms, and to improve structural characteristics of the material.

To provide a mineral coating on a structure made of a fibrous material, one or more cathodes are inserted in the structure, which is disposed in an electrolyte such as seawater, brine, or brackish water. One or more anodes are disposed in proximity to the structure, and a direct electrical current is established between the electrodes for a period of time sufficient to coat the structure and/or mineralize the fibrous material.

7 Claims, 6 Drawing Figures pH PROFILE

ACCRETION COATING AND MINERALIZATION OF MATERIALS FOR PROTECTION AGAINST BIODEGRADATION

BACKGROUND OF THE INVENTION

The present invention relates generally to construction materials and processes; and more particularly, it relates to the electrodeposition of minerals to form a material suitable for use as a coating and filler of wood and other like materials to inhibit biodegradation of such materials.

Seawater contains nine major elements: sodium magnesium, calcium, potassium, strontium, chlorine, sulphur, bromine and carbon. These elements comprise more than 99.9% of the total dissolved salts in the ocean (see Milliman, et al., *Marine Carbonates*, Springer-Verlag, N.Y., 1974; Sverdrup, et al., *The Oceans: Their Physics, Chemistry, and General Biology*, Prentiss-Hall, Inc., in N.J. 1942; and Culkin and Goldberg in Volume 1, *Chemical Oceanography*, pp. 121–196, Academic Press, London 1965). The constancy of the ratios of the major elements throughout the oceans has long been well-known (Dittmar, Challenger Reports, Physics and Chemistry, pp. 1–251, 1884).

In 1940 and 1947, G. C. Cox was issued U.S. Pat. Nos. 2,200,469 and 2,417,064, outlining methods of cathodic cleaning and protection of metallic surfaces submerged in seawater by means of a direct electrical current. During the cleaning process, a coating is also formed cathodically, consisting of magnesium and calcium salts (Eichoff and Shaw, Corrosion, No. 4, pp. 363–473, 1948). If these coatings are hard and continuous, they afford a considerable degree of corrosion protection to the enclosed metal (see Humble, Corrosion, No. 4, pp. 358–370, 1948, and Corrosion, Volume 4, No. 9, pp. 292–302, 1949).

Lower marine organisms utilize the minerals in solutions surrounding them to build structural formations. Mollusk shells, for example, are generally composed of calcium carbonate crystals enclosed in an organic matrix. A significant proportion of the soluble protein in the matrix is composed of a repeating sequence of aspartic acid separated by either glycine or serine (see Jope in Volume 26, *Comprehensive Biochemistry*, p. 749, Elsevier, Amsterdam, 1971). This sequence, comprising regular repeating negative charges, could bind $Ca^{2+}$ ions and thus perform an important function in mineralization of the template (Weiner and Hood, Volume 190, *Science*, pp. 987–989, 1975).

Although impressed current-produced calcium carbonate/magnesium hydroxide formations are known, such formations have never been thought of as primary coatings and/or mineralizing materials on and in a structure of wood or other organic fibrous/porous material with the intent to prevent biodegradation in seawater, or on land, and to strengthen the material.

SUMMARY OF THE INVENTION

The present invention provides a method of coating and mineralization of fibrous and porous materials to inhibit biodegradation and improve the structural characteristics of the material.

In particular, the present invention provides a method of coating and mineralizing a wood structure with a hard, strong mineral material to prevent attack by fouling and boring organisms, and to improve the structural integrity of the wood structure.

In accordance with the present invention, a mineral coating and filler for fibrous materials is obtained by accretion through the electrodeposition of minerals.

Briefly summarized, the method of the present invention for coating, and if desired mineralizing, a structure made of organic fibrous material involves inserting an electrically conductive element into the fibrous material structure and disposing the structure in a volume of electrolyte. The conductive element in the structure is made a cathode by connection to the negative potential terminal of a direct current electrical power supply. An anode is disposed in the electrolyte in proximity to the structure, and is connected to the positive potential terminal of the direct current electrical power supply. A direct electrical current is then established between the cathode and the anode for a time sufficient to coat the surface of the structure with electrodeposited minerals. Accordingly, there is provided an antifouling coating of hard, strong material resistant to attack leading to biodegradation.

Also with the foregoing method, the structure can be impregnated with electrodeposited minerals material (i.e., mineralized) as well as coated.

Preferably, the electrolyte utilized is seawater or brine, providing a coating material having a chemical composition that mainly includes brucite, aragonite, calcite, and calcium carbonate. However, any mineral-containing liquid may be used.

The method of the present invention can be applied to any wooden or fibrous material structure, which is to be used in or out of water. The method is particularly suitable, however, for coating wood pilings. The method can be applied to wood pilings either prior to installation or after installation.

Also, the polarity of the electrodes may be reversed such that the electrode inserted in the fibrous material to be coated becomes an anode. This would resuslt in the production of chlorine gas, which would exterminate all organisms present in the material.

BRIEF DESCRIPTION OF THE DRAWINGS

A written description setting forth the best mode presently known for carrying out the present invention, and of the manner of implementing and using it, is provided by the following detailed description of an illustrative embodiment and example, which refers to the accompanying drawings wherein.

DETAILED DESCRIPTION OF THE INVENTION

A. General Discussion

The oceans hold in solution a great material resource, acting as a link in the continual and vital cycle of material from land to sea. Each year, rivers contribute $2.73 \times 10^9$ metric tons of newly-dissolved solids. In the 70.8% of the earth's surface which is covered by water, there are over 60 quadrillion tons of mineral resources (Wenk, E., Jr., "The Physical Resources Of The Ocean," *The Ocean*, W. J. Freeman and Co., 1969).

Apart from oxygen and hydrogen, one cubic mile of seawater contains:

chlorine—89 500 000t
sodium—49 500 000t
magnesium—6 125 000t
sulphur—1 880 000t
calcium—1 790 000t
potassium—1 609 000t
bromine—306 000t
carbon—132 000t and 51 other minerals and elements.

The utilization of processes similar to those exhibited by the structural mechanisms of living organisms and in non-living environments, such as caverns, provides a mineral accretion technology which involves the deposition and calcification of minerals in solution for structural purposes. That is, through electrolytic processes (diagenesis) and subsequent biological phasing (biogenesis), unstructured materials are electrodeposited onto conductive forms and may be chemically transformed by biological organisms into materials with structural capabilities.

The deposition and calcification of minerals in the environment is made possible by the fact that the medium in which they are suspended, water, in an ampholyte—a substance which can behave as an acid or a base—making it the universal solvent. This unique quality is most simply illustrated by the structural and destructural system of caverns. When water contains carbon dioxide, which combines with water to make carbonic acid, materials are dissolved. When carbon dioxide escapes, water becomes a base and materials are precipitated as stalactites and stalagmites. Similar non-living processes occur throughout the environment in cycles of deposition and reclamation.

Electrolytic processes can be utilized to selectively precipitate materials onto suitable surfaces. A certain electrical potential between electrodes will deposit negative ions on the anode and positive ions on the cathode. During the electrodeposition process, there are three methods by which material can potentially be accreted on the cathode:

1. concentration gradients;
2. ionic attraction; and,
3. electric migration.

Figure 1:
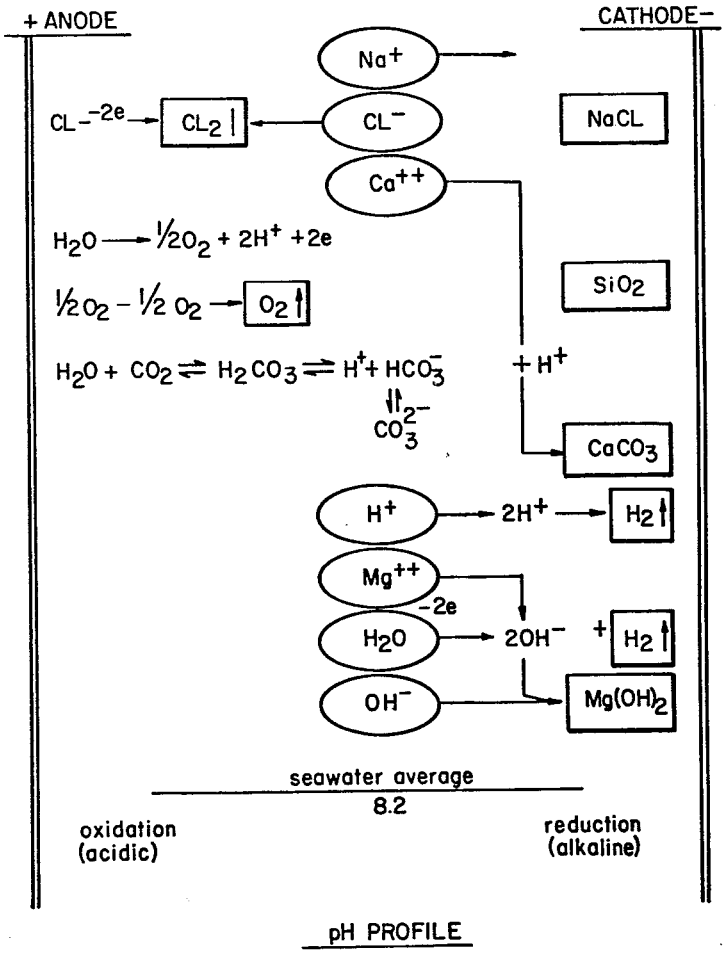
FIG. 1 depicts a theoretical qualitative model for the electrochemical processes involved in the accretion of minerals.

Although concentration gradients are most likely the cause of accretion, combinations of the three methods cannot be precluded. The basic model of the electrochemical reactions in a greatly simplified form is diagrammed in FIG. 1. In FIG. 1, the rectangular boxes represent either the mineral compounds precipitated from solution by the above methods, or the gases which are evolved. The arrows represent possible pathways of reactions according to the pH profile.

In addition to attracting ions, electrolysis of seawater produces heat at the electrode surfaces. The resistance is greatest at these surfaces; the temperature is, therefore, greater and the pH will rise. At first, the thermal decomposition removes the carbonic acid ($H_2CO_3$) allowing carbon dioxide ($CO_2$) to escape, which causes the hydrogen carbonate-carbonate equilibrium to shift to the carbonate side. The increased carbonate concentration, with increase in temperature and salinity, will increase the ionic product of calcium carbonate crystals, and induce precipitation. However, as the solution becomes more alkaline (at pH greater than 9), the ionic product of a brucite [$Mg(OH)_2$] will exceed the solubility product and brucite as well as the carbonates will be precipitated. The structural development in this case would be inhibited. It is also possible that amorphous matter enveloping the cathode, and the presence of other crystals such as phosphates, hydroxides, or sodium carbonate, inhibit the precipitation of calcium carbonate and prevent further growth of the crystals which do form.

It is evident from X-ray diffraction tests and chemical titration analysis that the greatest percentage of the material formed is brucite. It is found in two of its three distinct forms: the plate-like or foliate type; and massive material. Brucite, in its foliate form, is harder than talc or gypsum, and is not elastic; in its massive material form, it has a soapy appearance. It is possible that some small percentages of the composition consists of portlandite [$Ca(OH)_2$], which is isostructural with brucite. Fast precipitation of compounds from seawater usually results in brucite of the massive material form; slow precipitation usually results in brucite of the foliate crystalline structure. A major factor in the association of $Mg^{2+}$ in the form of $Mg(OH)_2$ is the reduction of $CO_2$ pressure in the upper reaches of the ocean. If the $CO_2$ pressure is increased to normal, lowering the pH, $Mg(OH)_2$ would revert to $MgCO_3$. Furthermore, the $MgCO_3$ would crystallize into available nuclei—i.e., aragonite and calcite.

B. Electrodeposition of Minerals On or With Fibrous or Porous Materials

To illustrate the use of mineral electrodeposition for coating a fibrous material structure with a hard, strong material, and/or mineralization of fibrous or porous materials, examples involving wood pilings will be described.

As used herein, "a hard, strong material" refers to a compression strength of at least 500 P.S.I. Also, as used herein, "mineralization" of a fibrous material refers to impregnation of the material with minerals. In the case of wood, for example, mineralization produces a "petrification" of the wood tissue, which prevents a boring and fouling attack thereon.

Figure 2:
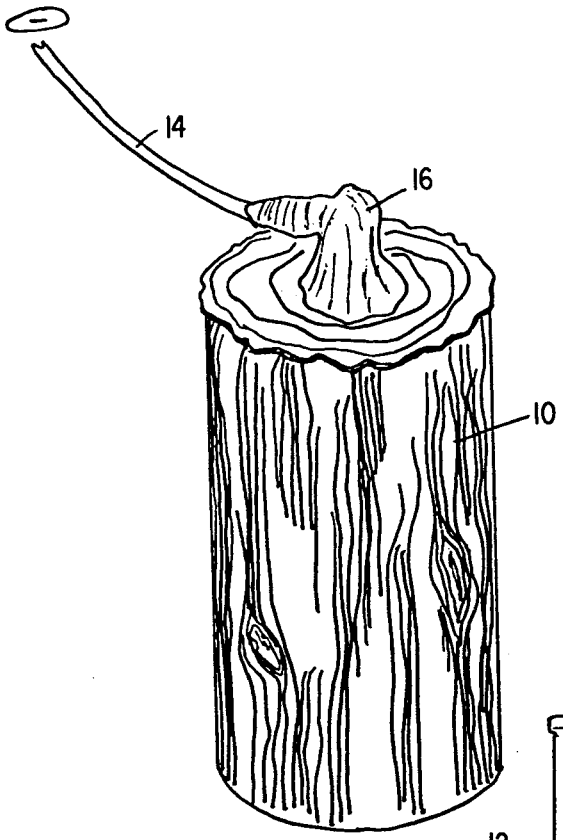
FIG. 2 is a perspective view of a wood piling having a cathode arrangement to mineralize the wood and form an exterior coating.
Figure 3:
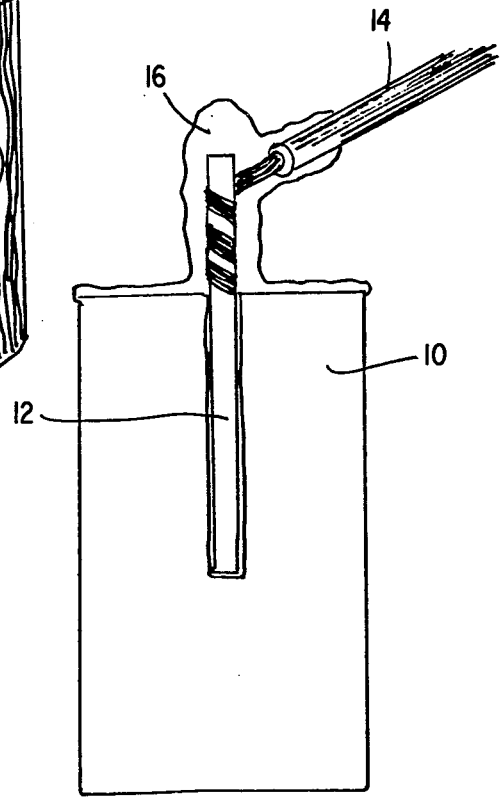
FIG. 3 is a cross-sectional view of the piling structure shown in FIG. 2.

Referring first to FIGS. 2 and 3, there is shown in perspective and longitudinal cross-section views, respectively, a wood piling 10. Wood piling 10 has driven or inserted therein an element 12 of electrically conductive material, such as iron, steel, lead, carbon or graphite. Electrically conductive element 12 is to be made a cathode by connection to the negative terminal of a direct electrical power supply by cable 14. Cable 14 is suitably a multistrand cable. The connection of cable 14 to conductive element 12 may suitably be by wrapping of the cable strands around element 12. Preferably, the strands are also soldered to the element to enhance the electrical connection. The connection is covered by a suitable insulating material 16 such as silicon. Piling 10 can be a typical wood piling, conventionally treated (i.e., creosote-treated) or untreated against attack by sea or land organisms, chemicals, and the weather.

To protect piling 10 against biodegradation and enhance its structural integrity, the piling is disposed in a volume of electrolyte, such as seawater or bine. Cable 14 is connected to the negative potential terminal of a direct current electrical power supply, making conductive element 12 a cathode. One or more anodes (not shown) are to be disposed in proximity to the piling 10. The anode(s) may be iron, steel, lead, graphite, carbon, platinum, columbium, or titanium. By cable or like electrical connection means, the anode(s) is connected to the DC electrical power supply. Then, a direct electrical current is established between the electrodes. Current is maintained for a time sufficient to accrete an exterior coating of a hard, strong minerals material. If desired, current may be maintained for a time sufficient for mineralization of the fibrous material of piling 10.

To provide details of the parameters of the process and equipment used, consider a wood piling 10 having dimensions of 18 inches in length and 12 inches in diameter. Conductive element 12 may then suitably be a ¾-inch diameter steel reinforcing bar inserted approximately 10 inches into piling 10. Cable 14 is an AWG4 copper wire cable. Two lead anodes are used and disposed approximately 10 feet away and on opposite sides of piling 10. The anodes are formed as metal sheets measuring 12 inches by 24 inches. Connection of the electrodes is to a 12 volt power supply. The preferred electrolyte is seawater or a brine solution.

Figure 4:
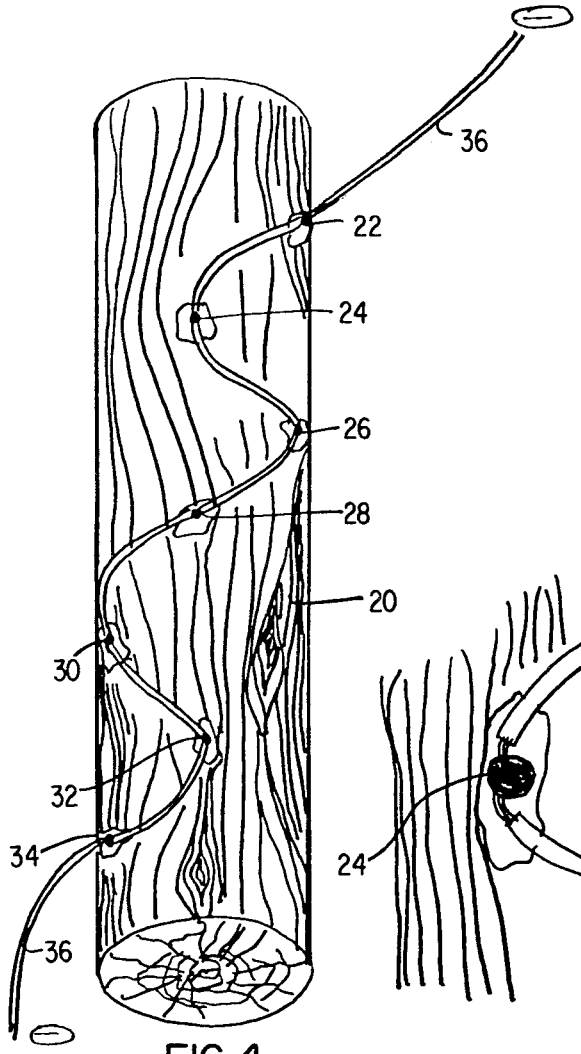
FIG. 4 is a perspective view of a wood piling provided with an alternate cathode arrangement to form an exterior coating of minerals material.
Figure 5:
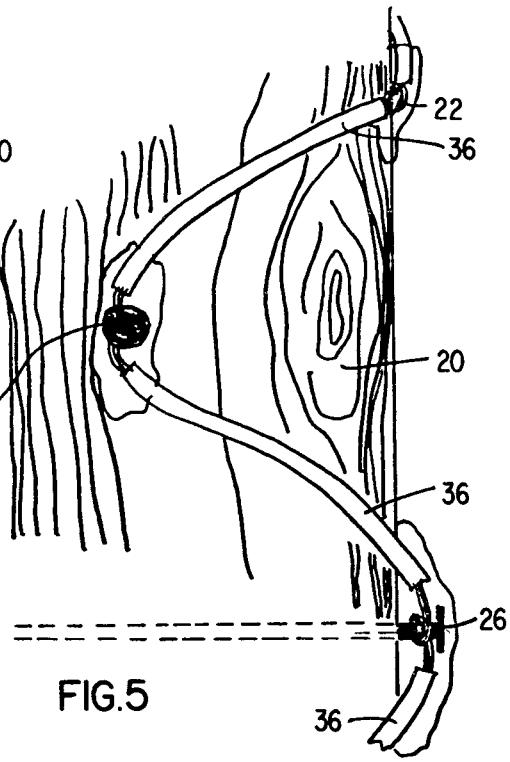
FIG. 5 is a detailed, close-up view of a section of the wood piling and cathode arrangement shown in FIG. 4.

Referring now to FIGS. 4 and 5, there is shown a wood piling 20 provided with an alternate cathode arrangement to that shown in FIGS. 2 and 3. In this cathode arrangement, conductive elements 22, 24, 26, 28, 30, 32 and 34 are driven horizontally into the side of piling 20 at distributed points on its surface. A wire cable 36 is connected at a point along its length and intermediate the ends to each iron nail. An insulation coating is provided on each segment of the wire cable between nail connections. An insulating material such as silicon is applied at each connection of the cable to a nail. The two ends of cable 36 are connected to the negative terminal of a DC electrical power supply.

To provide further definition of the parameters of the method of the present invention as applied using the alternate cathode arrangement of FIGS. 4 and 5, assume a wood piling 20 that measures 32 inches in length and 7 inches in diameter. Suitably, the electrically conductive elements driven into the piling are iron nails. Preferably, the nails are sized to extend all the way through the piling (i.e., the nail length equals the piling diameter). The interconnecting wire cable may be ⅝-inch copper with a PVC insulation. A single lead anode having dimensions of 12 inches by 24 inches is suitable, and positioned approximately 10 feet away from the piling. A 12 volt power supply may suitably be used as the electrical power source.

The direct current electrical power source utilized in either example above is desirably capable of producing a peak power output of at least 1000 watts. To coat the wood pilings of the stated dimensions, a continuous output of 10 amperes at approximately 12 volts would be required. The direct current electrical power supply could be a battery charger, a welding generator, an array of photovoltaic cells, or a prime mover-driven electrical generator.

The mechanical properties of electrodeposited minerals material obtained on one-half inch galvanized hardware cloth indicate that the material has a compression strength of 3720–5350 P.S.I. For comparison, normal portland cement type 1 concrete has a compression rating of 3500 P.S.I., and is typically used for stairs, steps, sidewalks, driveways, slabs on grade, and basement wall construction.

The strength of the material, and the extent to which there is mineralization of the fibrous material, will be affected by the rate of accretion. Fast accretion with a high current density gives lower strength; slower accretion with a lower current density yields a higher strength material. Strength may vary from 10–12,000 P.S.I. Usable current density may range up to 50,000 mA per square foot, and electric field potential between the electrodes may range up to 50,000 volts.

In the foregoing discussion, a totally electrolytic process is described. However, the coating and mineralization of fibrous material structures may also be produced by "phasing" which is a variation of the basic accretion process. "Phasing" as used herein refers to a process of accreting a structure in which electrodeposition (diagenesis) is first begun and continued through a first phase, and subsequently, during a second phase, the electrolytic process is discontinued and direct interaction of the deposited material with biological material (biogenesis) in the electrolyte proceeds, which may change the properties of the previously deposited material. After first and second phases, the process of coating and mineralizing the structure may be considered to be complete or electrodeposition may be resumed. If desired, diagenesis and biogenesis may be alternatively repeated several times during the coating and mineralization of a fibrous material structure.

Another variation on the procedure followed in the foregoing discussion is that of switching the polarity of the electrodes (i.e., the cathode becomes the anode and vice-versa). By switching polarity of the electrodes, the material on what originally was the cathode is altered and the original anode material is integrated into an accreted material. The polarity may again be switched to re-establish the original electrode polarities; in fact, switching of electrode polarity may be done a number of times to achieve a desired composition of accreted coating material. Also, switching polarity of the electrodes would result in the production of chlorine gas, which would exterminate all organisms in the material.

Figure 6:
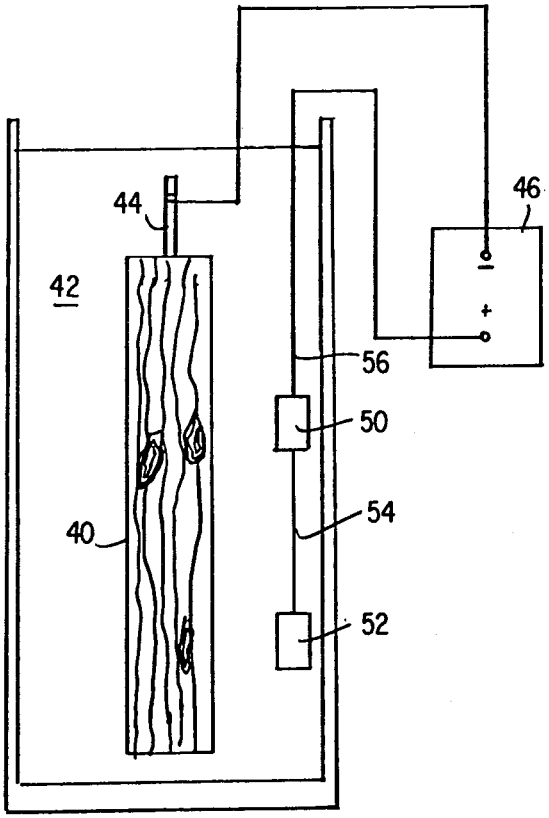
FIG. 6 is a schematic diagram of an arrangement for treating a wood piling to prevent biofouling.

Referring to FIG. 6, there is diagrammed an arrangement for treating a wood piling in accordance with the present invention to protect against biofouling. In FIG. 6, a wood piling 40 is disposed in a volume 42 of electrolyte. Suitably, the electrolyte is seawater or a brine solution. An electrically conductive element 44 is inserted into piling 40 and connected to a direct current electrical power supply 46. Specifically, element 44 is connected by a wire cable 48 to the negative potential terminal of power supply 46. Electrodes 50, 52 are disposed in the volume of electrolyte in close proximity to piling 40. Electrodes 50, 52 are connected together by wire cable 54, and connected to the positive potential terminal of power supply 46 by wire cable 56. By reason of element 44 being connected to the negative potential terminal of the power supply, it is a cathode. By reason of electrodes 50, 52 being connected to the positive potential terminal of power supply 46, they are anodes.

To accrete a hard, strong coating of minerals material on piling 40, direct current is established between the electrodes (i.e., cathode 44 and anodes 50, 52) for a sufficient time period. Also, the tissue of the wood may be mineralized if desired.

In the foregoing manner, there is produced a wood piling treated against biofouling.

The foregoing description of the invention has been directed to a particular coating and mineralization examples involving wood pilings for purposes of explanation and illustration. It will be apparent, however, to those skilled in this art that modifications and changes may be made in the method outlined without departing from the scope and spirit of the invention. It is the Applicant's intention in the following claims to cover such equivalent modifications and changes as fall within the scope of the invention as defined by the following claims.

What is claimed is:

1. A method of treating organic fibrous material to inhibit biodegradation, which comprises the steps of:
   - inserting an electrically conductive element into a body of organic fibrous material;
   - disposing the body of fibrous material in a volume of electrolyte;
   - disposing an anode in the electrolyte in proximity to the body of fibrous material;
   - connecting said anode to the positive potential terminal of a direct current electrical power supply;
   - connecting said electrically conductive element in said fibrous material to the negative potential terminal of said direct current electrical power supply, thereby making said element a cathode; and
   - establishing a direct electrical current between the cathode and the anode for a time sufficient for accreting a solid coating of high strength electrodeposited minerals material on the surfaces of said body of fibrous material.

2. The method of claim 1 wherein the electrical current density is 1–50,000 mA/sq. ft.

3. The method of claim 1 wherein the electric field potential between the electrodes is 1–50,000 volts.

4. The method of claim 1 wherein the electrolyte is a mineral-containing liquid.

5. A method of treating a wood structure to inhibit biodegradation, which comprises the steps of:
   - inserting an electrically conductive element into the wood structure;
   - disposing the wood structure in a volume of electrolyte;
   - connecting said electrically conductive element to the negative potential terminal of a direct current electrical power supply, thereby making said element a cathode;
   - disposing an anode in the electrolyte in proximity to the wood structure;
   - connecting said anode to the positive potential terminal of the direct current electrical power supply; and
   - establishing a direct electrical current between the cathode and the anode for a time sufficient for accreting a solid coating of a hard, high strength electrodeposited mineral material on the surfaces of the wood structure.

6. A method of protecting a wood piling against biofouling, comprising the steps of:
   - inserting an electrically conductive element into a wood piling;
   - disposing the wood piling in a volume of electrolyte;
   - connecting said electrically conductive element to the negative potential terminal of a direct current electrical power supply, thereby making it a cathode;
   - disposing an anode in the electrolyte in close proximity to the wood piling;
   - connecting the anode to the positive potential terminal of a direct current electrical power supply; and
   - establishing a direct electrical current between said electrodes for a time sufficient to accrete a coating of hard, strong minerals material on the surface of the wood piling.

7. A treated wood piling resistant to biofouling made by:
   - inserting an electrically conductive element into the wood piling;
   - disposing the wood piling in a volume of electrolyte;
   - connecting said electrically conductive element to the negative potential terminal of a direct current electrical power supply, thereby making said element a cathode;
   - disposing an anode in the electrolyte in proximity to the wood piling;
   - connecting said anode to the positive potential terminal of the direct current electrical power supply; and
   - establishing a direct electrical current between the cathode and the anode for a time sufficient for accreting a solid coating of a hard, high strength electrodeposited minerals material on the surfaces of the wood piling.

* * * * *